US006289887B1

(12) United States Patent
Oliver, Jr. et al.

(10) Patent No.: US 6,289,887 B1
(45) **Date of Patent: *Sep. 18, 2001**

(54) ARTIFICIAL CAMPFIRE DEVICE

(75) Inventors: Howard C. Oliver, Jr., Littleton; Patrick A. Marshall, Lakewood, both of CO (US)

(73) Assignee: Portafire, Inc., Littleton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/531,641

(22) Filed: Mar. 21, 2000

Related U.S. Application Data

(63) Continuation of application No. 09/288,409, filed on Apr. 8, 1999, now Pat. No. 6,044,836.

(60) Provisional application No. 60/095,744, filed on Aug. 7, 1998.

(51) Int. Cl.[7] ..... F24C 3/04

(52) U.S. Cl. ..... 126/92 AC; 126/41 R; 126/512; 126/519; 431/125

(58) Field of Search ..... 126/92 AC, 9 R, 126/9 A, 25 R, 25 B, 29, 41 R, 512, 519, 92 R; 431/125, 328, 329, 126; D23/317, 348

(56) References Cited

U.S. PATENT DOCUMENTS

| | | | | |
|---|---|---|---|---|
| 613,015 | * | 10/1898 | Monroe | 431/125 |
| 3,289,801 | * | 12/1966 | Jerkins | 126/41 R |
| 3,630,189 | * | 12/1971 | Hodges | 126/41 R |
| 3,641,922 | * | 2/1972 | Nachazel et al. | 126/25 B |
| 3,747,585 | * | 7/1973 | Coats | 126/92 R |
| 3,871,355 | * | 3/1975 | Henry | 431/125 |
| 5,901,697 | * | 5/1999 | Oliver, Jr. et al. | 126/92 AC |

* cited by examiner

*Primary Examiner*—James C. Yeung
(74) *Attorney, Agent, or Firm*—John L. Isaac; Isaac & Associates

(57) ABSTRACT

An artificial campfire device is disclosed and is fueled by a pressurized fuel source. The device includes a base receptacle which defines an open top, the base receptacle being adapted for placement on a ground surface. A burner member is positioned within the receptacle and is adapted to provide a flame of variable height. A fuel control mechanism is adapted for coupling a pressurized fuel source with the burner member for controlling the flow of fuel to the burner member and the size of flame emitted by the burner member. Finally, a plurality of artificial refractory log members are adapted for assembly in crisscross fashion to form a log cluster in the base receptacle.

20 Claims, 3 Drawing Sheets

FIG. 1
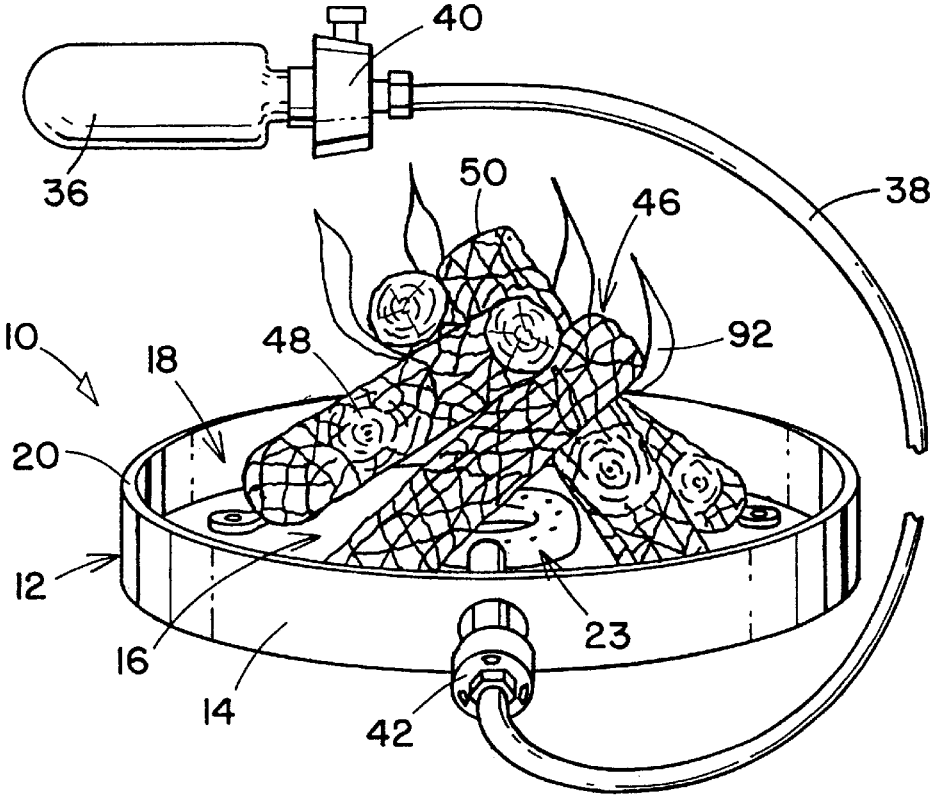
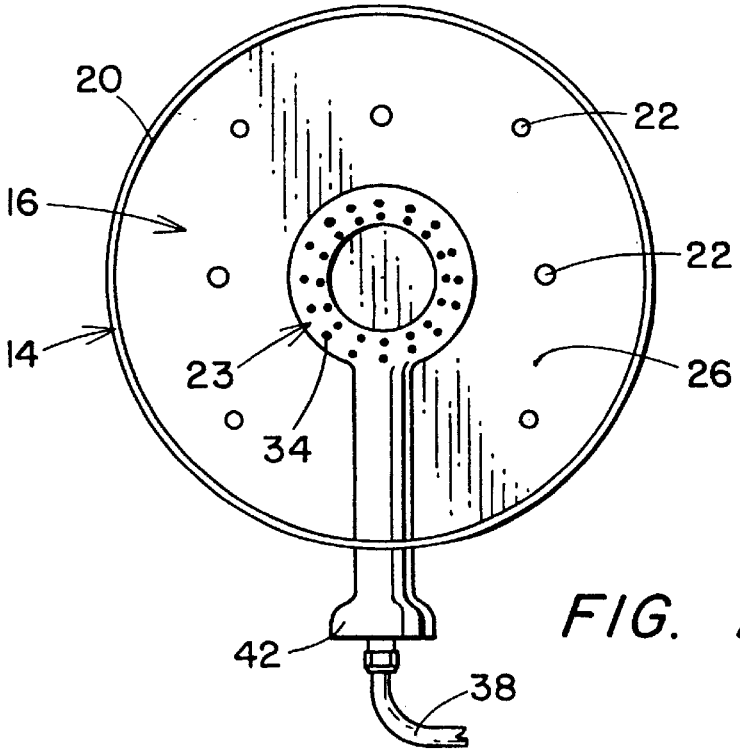
FIG. 2

FIG. 3
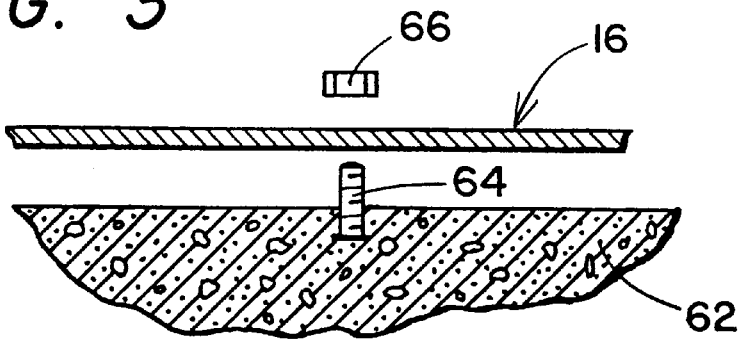
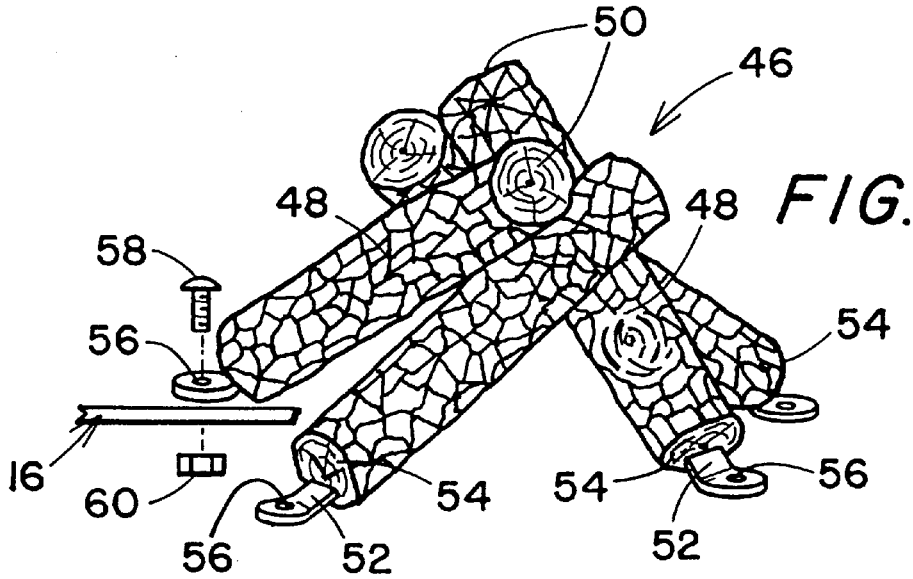
FIG. 5
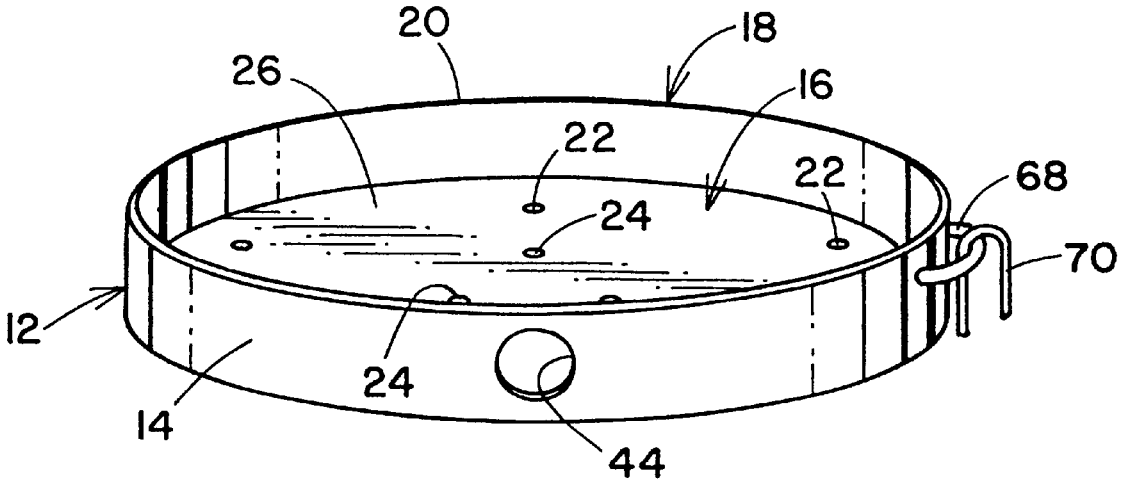
FIG. 4

ARTIFICIAL CAMPFIRE DEVICE

RELATED APPLICATION

This is a continuation of pending U.S. patent application Ser. No. 09/288,409, filed Apr. 8, 1999, now U.S. Pat. No. 6,044,836 which in turn is a continuation-in-part of U.S. Provisional Patent Application Serial No. 60/095,744, filed Aug. 7, 1998, the contents of which are specifically incorporated herein by reference. This application is also related to U.S. patent application Ser. No. 09/038,419, filed Mar. 11, 1998, which application issued on May 11, 1999 as U.S. Pat. No. 5,901,697, the contents of which is also specifically incorporated herein by reference.

BACKGROUND OF THE INVENTION

1. Field of the Invention

The present invention relates generally to gas burner devices and, more particularly, to devices using compressed gas and artificial logs. Specifically, the present invention relates to artificial campfire-type devices utilizing compressed gas for cooking and the like.

2. Description of the Prior Art

Portable devices and permanent fireplaces and fire pits are used by campers and homemakers to provide outdoor heat, cooking, and the pleasant appearances of a campfire. In addition, portable devices using compressed gas, such as bottled propane, have often been used as cooking devices in the outdoors. There are many examples of such devices. For example, U.S. Pat. Nos. 254,709, 3,593,647 and 5,413,087 all disclose portable-cooking devices that are operated utilizing pressurized fuel such as pressurized white gas and propane gas.

Other portable devices utilize compressed gas in combination with other fuel sources. These devices are generally intended to be utilized in the outdoors. U.S. Pat. No. 4,903,683 illustrates a system which incorporates charcoal in conjunction with pressurized gas. On the other hand, U.S. Pat. No. 5,094,223 discloses a portable fire pit grill device that combines pressurized gas with the burning of real wood.

Unfortunately, all of the above noted devices are specifically cooking devices adapted for portability to enable cooking in the outdoors. None of these devices utilize artificial or refractory logs. U.S. Pat. Nos. 3,362,395, 3,385,651 and 5,421,321 all disclose artificial fireplaces utilizing refractory logs and natural gas. These systems are designed to provide the pleasant appearance of fireplaces without the mess and difficulty of using real wood. However, while they are all permanent installations, they are designed for use indoors and are certainly not adaptable for use in the outdoors.

A traditional and almost essential part of camping in the outdoors, however, is having a wood-burning campfire, particularly in the evening. An open campfire provides both warmth as well as pleasant visual experiences. Unfortunately, there are many times that wood burning and open campfires are prohibited due to dry forest or environmental conditions. When such dry conditions prevail, fire danger is high. In such instances, the Forest Service restricts and even prohibits the burning of wood of any sort, and particularly open campfires. When such prohibitions are in force, traditional gas stoves such as described above may be utilized for cooking. However, there is to date no device which can substitute for an open campfire when such prohibitions are in force. Moreover, there is certainly no device which combines both the usefulness of a gas-cooking stove with the beauty and enjoyment of an open campfire without requiring the burning of wood.

The above referenced and related U.S. Pat. No. 5,901,697, the contents of which have been incorporated by reference and herein below, discloses a portable artificial campfire/cooking device which utilizes artificial logs and operates on compressed gas. This particular device generally satisfies and fulfills the aforementioned need with respect to campers who can transport such devices between campsites. However, there is a considerable need for individuals who wish to have a simple open campfire when open fire restrictions or prohibitions are in effect and who do not possess or have access to such an artificial portable campfire/cooking device or may not desire to use such a device as a cooking source. Finally, there is a distinct need within the various state and federal Forest Service agencies to be able to provide an acceptably safe alternative to an open campfire for use by campers and which, in certain embodiments, may be permanently installed at campsites provided and maintained by these agencies.

SUMMARY OF THE INVENTION

Accordingly, it is one object of the present invention to provide a campfire device which operates on pressurized gas.

It is another object of the present invention to provide a campfire device which does not require the use of real wood so that it can be operated during wood burning prohibition periods.

Yet another object of the present invention is to provide a gas operated artificial campfire that can also be utilized as a cooking device and which, in certain variations, may be permanently installed.

Still another object of the present invention is to provide an artificial campfire utilizing refractory logs which can also be operated as a cooking device.

To achieve the foregoing and other objects and in accordance with the purpose of the present invention, as embodied and broadly described herein, an artificial campfire device is disclosed. The device includes a base receptacle which defines an open top, the base receptacle being adapted for placement on a ground surface. A burner member is positioned within the receptacle and is adapted to provide a flame of variable height. A fuel control mechanism is adapted for coupling a pressurized fuel source with the burner member for controlling the flow of fuel to the burner member and the size of flame emitted by the burner member. Finally, a plurality of artificial refractory log members are adapted for assembly in crisscross fashion to form a log cluster in the base receptacle.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings:

FIG. 1 is a side perspective view, with some parts broken away, of one artificial campfire embodiment constructed in accordance with the present invention;

FIG. 2 is a top plan view of the embodiment illustrated in FIG. 1 without the log cluster arrangement positioned therein;

FIG. 3 is an enlarged, partial cross-sectional view of one attachment mechanism embodiment for an artificial campfire device constructed in accordance with the present invention;

FIG. 4 is a side perspective view of the container portion of the embodiment illustrated in FIG. 1;

FIG. 5 is a side perspective view of the artificial log cluster of the embodiment illustrated in FIG. 1;

DETAILED DESCRIPTION OF THE PREFERRED EMBODIMENTS

Figure 6:
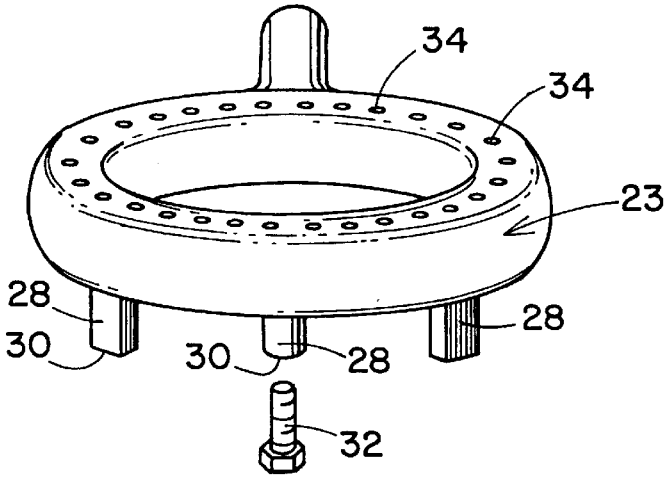
FIG. 6 is an enlarged side perspective view of a burner mechanism embodiment utilized with the device constructed in accordance with the present invention.

Referring first to FIGS. 1, 2, 4 and 6, an artificial campfire device 10 is designed for permanent installation at a campfire site and includes a base receptacle or container 12 preferably in the form of a pan-like device or shallow steel can. It should be understood, however, that the embodiments of the invention illustrated herein may be adapted either for permanent installation at a site to prevent theft or for fully portable use. The container 12 preferably includes an annular side portion in the form of a peripheral side edge 14, a bottom element 16 and an open top 18. It should also be understood that the size, shape or construction of the container 12 of this embodiment or the receptacle portion of any of the embodiments of the invention may be in any desired shape or form. The actual size, shape or form of the container 12 is unimportant to the operation of the invention and may be modified for aesthetic purposes.

Referring back to the FIGS. 1, 2, 4 and 6, the container 12 also preferably includes an annular top edge or lip 20 which defines the open end 18. In one form of the invention, the container 12 is formed from a 36" round galvanized steel base plate 16 which is approximately ¼" thick. The peripheral side edge 14 is approximately 6" in height and ¼" thick galvanized steel and is preferably securely welded to the plate 16. A first set of holes 22 are located in the bottom element 16 preferably midway between the center point of the bottom element 16 and the peripheral side edge 14, and a second set of at least three holes 24 are positioned radially about the center point of the bottom element 16. The holes 22 and 24 may be used to secure other components of the device 10 to the container 12 as described below in a permanently installed version of the invention.

A burner 23 is preferably provided in the lower portion of the container 12 spaced above the interior bottom surface 26 of the bottom element 16. In preferred form, the burner 23 includes a plurality of legs 28 which may be secured to the bottom interior surface 26 and are sized and shaped to carry the burner 23. Preferably, there are three legs 28 sized so as to position the burner 23 at least four inches, and preferably at least 4–6 in., above the interior bottom surface 26. The purpose for this positioning of the burner 23 is so that the burner 23 does not come too close to the bottom surface 26 to prevent overheating and possible fire danger. In one preferred form, each of the legs 28 includes an aperture 30 in the bottom foot thereof which is sized to receive a bolt 32. The bolt 32 is positioned under the bottom element 16 to pass upwardly through one of the holes 24 and firmly engage the leg aperture 30. In this manner, the burner 23 may be securely mounted to the bottom surface 26 of the bottom element 16 in a manner which deters theft since the bolts 32 are not readily accessible when the device 10 has been selectively permanently installed to a ground member as described below.

The burner 23 is preferably an 8-inch cast iron 40,000 BTU LP gas burner with an adjustable ventura which goes through a 6" high base ring. The burner 23 includes a plurality of burner nozzles 34 facing upwardly and which are sized and spaced so as to provide a wide flame area emitted therefrom. A source of pressurized fuel 36 is secured to the burner 23 by way of tubing 38, preferably LP gas low-pressure hose. In preferred form, the pressurized fuel 36 is compressed propane in the form of a 16.4 oz. disposable bottle of LP gas or a 20 pound bottle of LP gas with adapter that is refillable. A control valve or gas regulator 40 is utilized to control the flow of pressurized fuel from the fuel source 36 to the burner 23. The valve 40 may be a 3-way gas regulator when the gas source 36 is in the form of a disposable LP gas bottle. An adjustable air control vent 42 is preferably provided proximate the entry point 44 where the tube 38 passes into the container 12. It should be understood, however, that any type of pressurized gas source may be utilized in the present invention, such as pressurized white gas commonly used with camping stoves, and the like.

Figure 7:
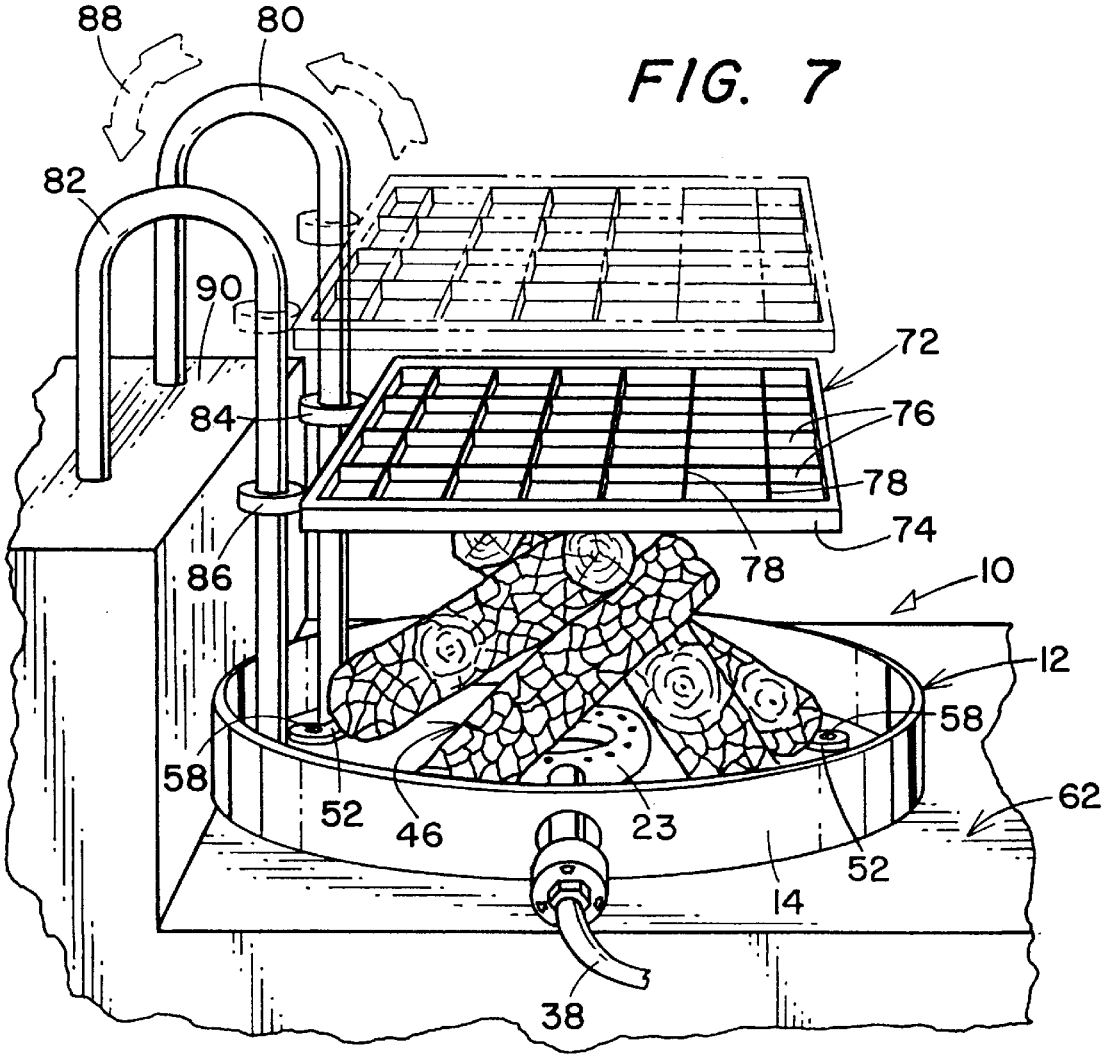
FIG. 7 is a side perspective view of an embodiment of the present invention mounted in a permanent position and including an adjustable grill mechanism utilized therewith.

Referring now to FIGS. 1, 5 and 7, a log cluster 46 is positioned within thecontainer 12. The log cluster 46 is made up of a plurality of refractory log members 48. It should be understood that in any of the embodiments of the invention, the log cluster 46 may comprise loosely assembled refractory log members or they may in fact be fixedly secured together. In one preferred form of the invention, each log member 48 is made from ceramic and is approximately 9 inches long, although any type of appropriate material may be used. There are preferably at least three log members 48 which, in this embodiment, are secured to each other in a crisscross arrangement to simulate a teepee-shaped campfire made from traditional wooden logs. The logs 48 may be secured or assembled to each other in any known manner, such as by bolts, refractory cement and the like. On the other hand, when theft is not a concern they clearly may simply be laid on each other without being specifically attached to each other. The logs 48 both retain and emit heat just like a real wood campfire, and this feature is coupled with the capability of instantly generating either a small hot blue flame or a large natural orange flame of variable height.

The log cluster 46 of this illustrated embodiment is positioned within the container 12 in an upwardly oriented manner. In one preferred form, the log cluster 46 is permanently affixed to the bottom element 16 to prevent theft and is selectively positioned so that the upper distal ends 50 of the logs 48 project above the open top 18. However, the log cluster may be unattached to any other component of the device 10 if the device 10 is not going to be permanently installed. To accomplish the illustrated attachment of the log cluster 46, an attachment member 52 is secured to the lowermost end 54 of each of the logs 48. Each attachment member 52 includes an aperture 56. An anchor bolt 58 passes through the aperture 56 of the attachment member 52 and through a hole 22 in the bottom element 16 and is secured to a nut or other member 60 positioned under the bottom element 16. In this manner, each log 48 of the log cluster 46 is securely mounted to the bottom surface 26 of the bottom element 16 in a manner which deters theft since the nuts 60 are not readily accessible once the device 10 has been permanently installed to a ground member as described below. In another embodiment of the invention, the attachment members 52 and/or the anchor bolts 58 can be directly welded to the bottom surface 26 of the bottom element 16. In preferred form, the attachment members 52 are arranged to be secured to the holes 22 which in turn are preferably arranged in a square pattern 22" apart on the bottom element 16.

As described above, the log cluster 46 and the burner 23 may be securely mounted to the container 12 in a manner that deters theft. Likewise, the container 12 may be secured to a permanently fixed ground member 62 to provide permanent installation of the device 12 at a campsite. Campsites typically already include a concrete fire pit for natural wood fires. In one preferred form of the invention, the container 12 is secured to a flat concrete slab 62 to provide theft deterrence. Preferably, an anchor bolt member 64 is permanently affixed in the concrete and projects upwardly therefrom. The assembled container 12 is then set on top of the concrete slab so that the bolt member 64 projects through a hole 22 in the bottom element 16. Then, the anchor bolt member 64 can be welded to the bottom element 16 or can be secured by an attachment nut 66 which in turn is permanently affixed in place by any means known to the art.

In an alternate embodiment, the container 12 can include a pair of anchor rings 68 disposed on the external surface of the peripheral side edge 14. The anchor rings are then secured to the concrete slab 62 utilizing any desired means such as U-bolts 70. The U-bolts 70 are permanently fastened to the slab 62 in any desired manner once they have been passed through the anchor rings 68. In this manner, the container 12 may be permanently installed to the concrete slab 62 after the components thereof are fastened in place. Thus, the device 10 may be permanently installed at a campsite without the worry and problem of theft of the entire device or components thereof.

The device 10 can be utilized either as an artificial campfire or as a gas fueled cooking device in either its permanently fixed or portable form. When it is desired to utilize the device 10 as a cooking device, a grill member 72 may be provided and sized and shaped for positioning over the open top 18. In one form of the invention and as illustrated in FIG. 7, the grill member 72 preferably includes a frame 74 having a plurality of first arms 76 and a plurality of second arms 78 which are arranged at approximately right angles across the first arms 76. This arrangement of the crossing arms 76 and 78 within the frame 74 creates a grid on which food items may be placed for cooking over the log cluster 46.

To position the grill member 72 over the log cluster 46, a pair of support brackets or arms 80, 82 may be mounted proximate the container 12. Specifically, the brackets 80, 82 are mounted at one end exterior to the container 12 and preferably to the fixed ground member 62, and at their opposite ends inside the container 12 and preferably to the bottom element 16. In preferred form, the opposite ends of the brackets 80, 82 include foot members which are attached to the bottom surface 26 of the bottom element 16. The frame 74 preferably includes a pair of attachment rings or grommets 84, 86 which are sized to snugly and slidingly fit over the brackets 80, 82, respectively. The weight of the grill member 72 causes the grommets 84, 86 to angle against the brackets 80, 82 so as to maintain the grill member's relative position thereto. When it is desired to change the position of the grill member 72 relative to the log cluster 46, the grommets 84, 86 of the grill member 72 are simply slidingly moved along the brackets 80, 82 until the desired position is attained. When it is desired to completely remove the grill member 72 from over the log cluster 46 to utilize the device 10 as an artificial campfire, the grill member is slidingly moved along the brackets 80. 82 in the direction of the arrow 88 until the grill member 72 has flipped over and covers the surface 90 of the concrete slab 62.

It should be understood, however, that any type of grill construction may be utilized as the grill member 72 with the present invention. When the device 10 is utilized as a cooking device, the log cluster 46 is positioned in its vertical position wherein the log cluster 46 is located within the container 12 above the plane of the open top 18. In this manner, the grill member 72 may be adjusted along the brackets 80, 82 without contacting the log cluster 46. A flame 92 (FIG. 1) may then be created by lighting the burner 23 fueled by the gas source 36. Once the refractory logs 48 have been heated, the gas flow from the gas source 36 may then be reduced so as to lower the flame 92 for cooking, since the refractory logs 48 will continue to radiate heat.

As previously described, the vertical position of the grill member 72 over the log cluster 46 is completely adjustable along the brackets 80, 82 when using the device 10 as a cooking device. When it is desired to use the permanently installed device 10 as an artificial campfire, the grill member 72 may be moved over onto the surface 90 away from the log cluster 46. This will position the upper portion of the log cluster 46 above the open top 18 and lip 20. In this position, the flame 92 can be adjusted to form a small flame or a large flame reaching 8–12 inches above the top of the log cluster 46 to simulate, respectively, a small or a large wood burning campfire.

As can be seen from the above, the present invention provides an artificial campfire device that is self-contained, does not require additional fuel sources and can, in certain embodiments, be used as a cooking device. The device of the present invention may be portable or it may be permanently installed at a campsite or the like when theft is a concern. It is safe and is ecologically minded due to the fact that it does not burn fossil fuel sources such as wood, charcoal and the like, thereby avoiding smoke and other emissions. The present invention meets the National Forest Service requirements for a legal fire during a no wood-burning ban. Therefore, it provides the warmth and beauty of an open campfire during times that traditional wood burning campfires are prohibited.

The device of the present invention also provides an instant on-off capability with either hot blue flames or natural orange flames. Moreover, flames of various desired heights can be created utilizing the present invention. The artificial logs utilized with the present invention provide not only visual sensory benefits but also retain heat for continued warmth even after the gas source has been turned off. The present invention is especially useful for camping, particularly where wood burning and noise from woodcutting is prohibited. It is useful in virtually any situation where a campfire would be desirable or enjoyable but not permissible under the circumstances. Moreover, it can also be useful where a gas fueled cooking device would be desirable in conjunction with the ability to have an artificial campfire. Finally, since the artificial campfire of one embodiment of the present invention is not intended to be portable, the permanently installed device is designed to be substantially theft-proof in its construction and installation, thereby making it an attractive device for installation and use at state and national Forest Service campsites.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

We claim:

1. An artificial campfire device fueled by a pressurized fuel source for use in the out-of-doors and adapted for portability and placement on a ground surface, said device comprising:

a base receptacle defining an open top for exposure to an out-of-doors environment, said base receptacle being adapted for selective placement on a ground surface;

a burner member positioned within said receptacle and adapted to provide a flame of variable height;

a plurality of artificial refractory log members adapted for assembly in crisscross fashion spaced above said burner member to form a log cluster in said base receptacle; and a fuel control mechanism adapted for coupling a pressurized fuel source with said burner member for controlling the flow of fuel to said burner member and the size of flame emitted by said burner member to surround said log cluster to simulate a natural wood burning outdoor campfire.

2. The device a s claim ed in claim 1, wherein said device further includes means for mounting a grill member in selectively variable positions over said open top above said log cluster.

3. The device as claimed in claim 2, wherein said grill member comprises a frame enclosing a plurality of arms crossing each other to form a grid, and a plurality of support arms for selectively positioning said grill frame in various selected positions above said open top, each support arm having one end portion secured to said receptacle and the opposite end portion disposed exterior to said base receptacle, said frame including a pair of attachment members slidably attached about said support arms.

4. The device as claimed in claim 3, wherein said pair of attachment members comprise one set of attachment rings disposed about said support arms to selectively engage said support arms to define a plurality of vertical positions for said grill frame above said receptacle open top.

5. The device as claimed in claim 1, wherein said base receptacle is mountable to a fixed ground member.

6. The device as claimed in claim 5, wherein said plurality of artificial refractory log members are secured to each other in crisscross fashion to form a fixed log cluster secured to said base receptacle.

7. The device as claimed in claim 1, wherein said device further includes theft-proof means for securing said base receptacle to a permanently attached ground member, and wherein said burner and said log cluster each includes theft-proof means for securing them to said receptacle bottom surface.

8. The device as claimed in claim 7, wherein each said theft-proof securing means comprises attachment members which are inaccessible from the exterior thereof when said campfire device is completely assembled.

9. An artificial campfire device comprising:

a receptacle having upper and lower portions and an open top defined by said upper portion;

a burner element positioned within said receptacle adapted to provide a flame of variable height;

a control mechanism for coupling a pressurized fuel source positioned exterior to said receptacle with said burner element for controlling the flow of fuel to and the size of flame emitted by said burner element;

a plurality of artificial refractory log members selectively mountable to each other in a fixed manner to form a log cluster simulating campfire logs; and a mechanism for supporting said log cluster within said receptacle comprising a plurality of support arms projecting therein.

10. The device as claimed in claim 9, wherein said device further includes means for selectively mounting a grill member over said open top above said log cluster.

11. The device as claimed in claim 9, wherein said log cluster support mechanism is adapted to define at least a first vertical position for said log cluster within said receptacle wherein said log members project above the plane of said open top.

12. A portable artificial campfire device utilizing pressurized gas from a gas source disposed exterior thereto to simulate a natural wood burning outdoor campfire, said device comprising:

a container having a substantially closed base portion, an open-ended top portion including a top edge defining the open end thereof for exposure to an out-of-doors environment, and an interior bottom surface;

a burner mounted in said base portion spaced above said bottom surface;

a plurality of refractory log members having upper and lower ends and adapted for assembly crisscross to each other in teepee-like alignment to form a log cluster simulating campfire logs;

a mechanism for supporting said log cluster within said container; and a fuel regulator coupling the gas source to said burner for controlling the flow of pressurized gas to said burner as well as for controlling the size of flame emitted by said burner to surround said log cluster to simulate a natural wood burning outdoor campfire.

13. The device as claimed in claim 12, wherein said plurality of artificial refractory log members are secured to each other in crisscross fashion to form a fixed log cluster.

14. The device as claimed in claim 13, wherein said fixed log cluster is fixedly attached within said container.

15. The device as claimed in claim 12, wherein said device further includes means for selectively mounting a grill member over said open end above said log cluster.

16. An artificial campfire device fueled by a pressurized fuel source and adapted for mounting onto a fixed ground member, said device comprising:

a base receptacle having a peripheral edge defining an open top and an interior bottom surface, said base receptacle being mountable onto a fixed ground member;

a burner member mounted to an d positioned above said interior bottom surface adapted to provide a flame of variable height;

a fuel control mechanism adapted for coupling a pressurized fuel source exterior to said receptacle base with said burner member for controlling the flow of fuel to said burner member and the size of flame emitted by said burner member; and a plurality of artificial refractory log members securable to each other in crisscross fashion to form a log cluster, said log cluster being adapted for positioning on said base receptacle bottom surface.

17. The device as claimed in claim 16, wherein said log cluster is fixedly secured to said base receptacle bottom surface.

18. The device as claimed in claim 16, wherein said log members are secured to each other to form said log cluster.

19. The device as claimed in claim 17, wherein said base receptacle is permanently securable to said ground member to form a campfire device permanently installable onto said fixed ground member.

20. A n artificial campfire device fueled by a pressurized fuel source and adapted for placement on a ground surface, said device comprising:

a base receptacle defining an open top, said base receptacle being adapted for placement on a ground surface;

a burner member positioned within said receptacle and adapted to provide a flame of variable height;

a fuel control mechanism adapted for coupling a pressurized fuel source with said burner member for controlling the flow of fuel to said burner member and the size of flame emitted by said burner member;

a plurality of artificial refractory log members adapted for assembly in crisscross fashion to form a log cluster in said base receptacle;

a grill member having a frame enclosing a plurality of arms crossing each other to form a grid; and a plurality of support arms for selectively positioning said grill member in various selected positions above said open top, each support arm having one end portion secured to said receptacle and the opposite end portion disposed exterior to said base receptacle, said frame including a pair of attachment members slidingly attached about said support arms.

* * * * *